US011515109B2

(12) United States Patent
Errico et al.

(10) Patent No.: US 11,515,109 B2
(45) Date of Patent: Nov. 29, 2022

(54) HIGH VOLTAGE DISCONNECTOR

(71) Applicant: Hitachi Energy Switzerland AG, Baden (CH)

(72) Inventors: Ennio Errico, Casirate d'Adda (IT); Matteo Calamari, Vigolzone (IT); Roberto Fabbi, Massalengo (IT)

(73) Assignee: Hitachi Energy Switzerland AG, Baden (CH)

( * ) Notice: Subject to any disclaimer, the term of this patent is extended or adjusted under 35 U.S.C. 154(b) by 0 days.

(21) Appl. No.: 16/973,073

(22) PCT Filed: Jun. 5, 2019

(86) PCT No.: PCT/EP2019/064679
§ 371 (c)(1),
(2) Date: Dec. 8, 2020

(87) PCT Pub. No.: WO2019/234110
PCT Pub. Date: Dec. 12, 2019

(65) Prior Publication Data

US 2021/0249207 A1 Aug. 12, 2021

(30) Foreign Application Priority Data

Jun. 8, 2018 (EP) ..... 18176731

(51) Int. Cl.
*H01H 1/42* (2006.01)
*H01H 33/12* (2006.01)

(52) U.S. Cl.
CPC ..... *H01H 33/123* (2013.01); *H01H 1/42* (2013.01); *H01H 33/127* (2013.01)

(58) Field of Classification Search
CPC .... H01H 33/123; H01H 33/127; H01H 33/64; H01H 33/124; H01H 33/12; H01H 1/42; H01H 2001/425; H01H 31/026
(Continued)

(56) References Cited

U.S. PATENT DOCUMENTS 4,005,340 A 1/1977 Hartel
4,070,641 A 1/1978 Khalid
(Continued)

FOREIGN PATENT DOCUMENTS

DE 1637309 U 4/1952
DE 1740074 U 2/1957
(Continued)

OTHER PUBLICATIONS

International Search Report and Written Opinion of the International Searching Authority, PCT/EP2019/064679, dated Sep. 24, 2019, 13 pages.
(Continued)

*Primary Examiner* — William A Bolton
(74) *Attorney, Agent, or Firm* — Sage Patent Group

(57) ABSTRACT

A high voltage disconnection unit includes a fixed contact assembly having at least a first fixed main contact and a first fixed auxiliary contact, a movable contact assembly having at least a first movable main contact and a first movable auxiliary contact that rotate with respect to the first fixed main contact and first fixed auxiliary contact from a contacts closed position to a contacts open position. During an opening operation of the disconnection unit the separation of the first movable main contact from the first fixed main contact takes place before the separation of the first movable auxiliary contact from the first fixed auxiliary contact. The relative opening speed V1 between the first movable auxiliary contact and the first fixed auxiliary contact is greater than the relative opening speed V2 between the first movable main contact and the first fixed main contact.

19 Claims, 8 Drawing Sheets

(58) Field of Classification Search
USPC ..... 200/472, 451, 471, 16 F, 15, 48 KB, 200/746 R, 48 R
See application file for complete search history.

(56) References Cited

U.S. PATENT DOCUMENTS 4,362,915 A 12/1982 Swindler
4,926,018 A * 5/1990 Buxton ..... H01H 9/383 218/20
5,359,161 A * 10/1994 Leach ..... H01H 1/225 200/250
5,629,658 A 5/1997 Chen
5,635,692 A * 6/1997 Ward, Jr. ..... H01H 33/168 218/146
5,684,280 A * 11/1997 Franz ..... H01H 1/36 200/16 R
2014/0246298 A1* 9/2014 Errico ..... H01H 31/003 200/48 R
2017/0103858 A1* 4/2017 Abroy ..... H01H 21/54

FOREIGN PATENT DOCUMENTS

DE 1154169 B 9/1963
DE 1182323 B 11/1964
EP 1121738 A1 8/2001
EP 2772928 A1 9/2014
WO 0030137 A1 5/2000

OTHER PUBLICATIONS

Extended European Search Report dated Nov. 28, 2018 for European Patent Application No. 18176731.0, 8 pages.

* cited by examiner

HIGH VOLTAGE DISCONNECTOR

CROSS REFERENCE TO RELATED APPLICATIONS

This application is a 35 U.S.C. § 371 national stage application of PCT International Application No. PCT/EP2019/064679 filed on Jun. 5, 2019, which in turns claims foreign priority to European Patent Application No. 18176731.0, filed on Jun. 8, 2018, the disclosures and content of which are incorporated by reference herein in their entirety.

The present invention relates to a high voltage disconnector, in particular to a contact assembly of a high voltage disconnector or combined disconnector and earthing switch used in high voltage metal-enclosed switchgears. For the purposes of the present invention, the term "high voltage" is used to designate operating voltages above 1000 volts AC.

In particular, the high voltage disconnector according to the invention, thanks to its innovative structure, allows optimizing the execution of the required electrical operations according to a solution which is at once simple, effective and compact.

It is known from the state of the art that electrical operations for disconnection, or for disconnection and earthing, in gas-insulated switchgear apparatuses can be performed by means of the translation movement of one or more movable contacts which can couple/uncouple with respect to corresponding fixed contacts. A significant drawback of known types of device is due to the fact that in order to perform the various operations, for example for disconnection on the input line or on the output line, they use dedicated components which are structurally separate and distinct with respect to each other. In this manner, the number of components used to implement the various operation is large and entails an increase in the overall dimensions and volume of the apparatus, with a consequent additional burden in terms of costs.

It is also known from the state of the art that disconnection units or combined disconnection and earthing units can be operated by rotating actuation means, typically a motor drive. A movable contact is usually rigidly fixed to the motor and rotates rigidly with it to carry out the required disconnection and/or earthing operations.

In order to withstand the electrical arcs developed during the opening/closing operations, the fixed and movable contact assemblies are normally provided with auxiliary contacts made of, or comprising, materials with better resistance to the electrical arcs, such as W/Cu alloys, into which the current is switched during the opening/closing operations.

In particular cases, such as in Bus Transfer operations in Double Bus Bar (DBB) Air Insulated Switchgears (AIS), it is necessary to deal with a certain voltage difference between the two bus bars, due to significant voltage drops, which is generally much higher than in Gas Insulated Switchgears (GIS). Under such conditions there is a significant arc energy that may lead to rapid ablation of arcing contacts material.

To ensure proper functionality of the switchgear, the standard requirements for such applications (e.g. IEC Standard Bus Transfer Current Switching test) are therefore particularly severe in defining voltage and current ratings to be applied to the Bus Transfer Current Switching test, consisting of N° 100 CO operations.

For instance, with reference to applications with 170 kV nominal voltage and rated normal current ≥2000 A, Bus Transfer ratings are 100 V/1600 A. In these conditions, at the normally used speed for rotating contacts, auxiliary contacts are subjected to electric arc duration prolonged in the time, for instance of >100 ms, in Opening, with significant pre-arcing in Closing.

Such significant arc energy leads to rapid ablation of arcing contacts material, losing insulation coordination. Nominal contacts are progressively affected by the arc, losing the DS functionality and leading to a failure of the Bus Transfer test.

In order to avoid the problem outlined above, and to survive a Bus Transfer test with a rotating DS or combined DS/ES, the electric arc duration in Opening has to be strongly reduced to acceptable arc energy levels.

The relative opening speed between arcing contacts should be therefore significantly increased, e.g., at least 10 times more. This could be achieved with a high-speed drive, but such solution would inevitably lead to significant oversizing of the motor drive and increase of cost and technical risk (mechanical, sealing, etc.).

On the basis of the above considerations, there is a need to have available technical solutions for a high voltage disconnection unit that will enable the limits and the problems set forth above to be overcome.

Hence, the present disclosure is aimed at providing a high voltage disconnection unit, which allows overcoming at least some of the above-mentioned shortcomings.

In particular, the present invention is aimed at providing a high voltage disconnection unit which is able to withstand the adverse electrical arc effects during the opening/closing operations of the disconnection unit.

Furthermore, the present invention is aimed at providing a high voltage disconnection unit which is able to guarantee proper arc resistance without oversizing the actuation drive of the disconnection unit.

Moreover, the present invention is aimed at providing a high voltage disconnection unit in which the ablation of the contact surfaces in case of formation of an electrical arc is significantly reduced.

Also, the present invention is aimed at providing a high voltage disconnection unit in which the risk of pre-striking of an electric arc during the closing operation is significantly reduced.

In addition, the present invention is aimed at providing a high voltage disconnection unit, which is able to pass the Bus Transfer standard test with a certain safety margin.

Furthermore, the present invention is aimed at providing a high voltage disconnection unit in which the general power test performances of the rotating DS or combined DS/ES are increased.

Also, the present invention is aimed at providing a high voltage disconnection unit, which has a compact structure with a reduced number of components, is reliable and relatively easy to produce at competitive costs.

Thus, the present invention relates to a high voltage disconnection unit which comprises a fixed contact assembly having at least a first fixed main contact and a first fixed auxiliary contact, a movable contact assembly having at least a first movable main contact and a first movable auxiliary contact that rotate with respect to said first fixed main contact and first fixed auxiliary contact from a contacts closed position to a contacts open position. The high voltage disconnection unit of the present disclosure is characterized in that during an opening operation of said disconnection unit the separation of said first movable main contact from said first fixed main contact takes place before the separation of said first movable auxiliary contact from said first fixed auxiliary contact, and is further characterized in that the relative opening speed V1 between said first movable auxiliary contact and said first fixed auxiliary contact is greater than the relative opening speed V2 between said first movable main contact and said first fixed main contact.

As better explained in the following description, thanks to the particular structure of the high voltage disconnection unit of the present invention—and in particular of the fixed and movable contacts assemblies—the above-mentioned problems can be avoided, or at least greatly reduced.

In practice, in the high voltage disconnection unit of the present disclosure, the separation of the movable main and auxiliary contacts from the corresponding fixed main and auxiliary contacts takes place at different moments and with different speeds, the separation of the auxiliary contacts taking place later and at a greater speed with respect to the separation of the main contacts.

In this way, the arc duration is significantly reduced without the need of oversizing the actuation drive of the movable contact assembly. Indeed, while the speed V2 of the first main movable contact can be kept at relatively low values, such as, e.g., <1.5 rad/s, the speed V1 of the first auxiliary movable contact can be as high as one order of magnitude greater than V2, or even more. In this way, the arc duration can be strongly reduced.

As better explained in the following description, in a typical embodiment of a high voltage disconnection unit according to the present disclosure, the movable contact assembly can advantageously comprise an elastic device acting on said first movable auxiliary contact with a snapping action when it separates from the corresponding first fixed auxiliary contact, thereby imparting to said first movable auxiliary contact said opening speed V2.

In such a case, said elastic device can conveniently comprise a spring device, for instance one or more springs properly positioned to impart said snapping action to the first movable auxiliary contact.

In an advantageous embodiment of high voltage disconnection unit, according to the invention, the first movable main contact preferably rotates around a first rotation axis and the first movable auxiliary contact rotates around a second rotation axis different and separated form said first rotation axis.

In practice, in the high voltage disconnection unit of the present invention, the opening speed V1 is the rotation angular speed of said first movable auxiliary contact around said second rotation axis, while the opening speed V2 is the rotation angular speed of said first movable main contact around said first rotation axis.

In this case, in a largely preferred embodiment of a high voltage disconnection unit, said second rotation axis is advantageously pivotally fixed on said first movable main contact so that the relative position of said second rotation axis with respect to said first fixed main and auxiliary contacts changing during a rotation of said first movable main contact.

In practice, according to this embodiment, during the disconnecting operation of the high voltage disconnection unit the second rotation axis of the first movable auxiliary contact is not fixed with respect to the fixed contact assembly but changes. In particular, as better explained hereinafter, the distance between the second rotation axis of the first movable auxiliary contact and said first fixed main and auxiliary contacts increases during at least a phase of the disconnection operation.

In a particular embodiment of the presently disclosed high voltage disconnection unit, said first movable main contact comprises a first and a second contact arms which are parallel to each other and spaced apart from each other along a first rotation axis, said first movable auxiliary contact being positioned in between said first and second contact arms.

A typical embodiment of a high voltage disconnection unit is characterized in that said fixed contact assembly comprises a fixed contact body. The first fixed main contact then comprises advantageously a first and a second contact surfaces, which are positioned on opposite faces of said fixed contact body. In turn, the first fixed auxiliary contact preferably comprises a third contact surface, which is positioned on a bottom portion of said fixed contact body. For the purposes of the present invention, the term "bottom portion" designate the portion of the fixed contact body which is the closest to the first movable auxiliary contact.

Moreover, said first and second contact surfaces are substantially parallel to each other, said third contact surface being substantially perpendicular to said first and second contact surfaces.

In practice, in this largely preferred embodiment of the present invention, the fixed contact assembly is formed by a single fixed contact body, having two parallel surfaces on a first and second opposite face forming said first and second contact surfaces, and a third surface, on a third face perpendicular to said first and second opposite faces, forming said third contact surface.

In such a case, according to preferred embodiments of the high voltage disconnection unit of the present disclosure, said first and second contact arms of said first movable main contact advantageously comprise contact strips on their respective facing surfaces, said contact strips being operatively couplable to said first and second contact surfaces of said fixed contact body, as better explained hereinafter.

In turn, said first movable auxiliary contact advantageously comprises a contact support which is rigidly fixed on said second rotation axis and a contact head at an end of said contact support, said contact head being operatively couplable to said third contact surfaces of said fixed contact body, as better explained hereinafter.

In an embodiment of the high voltage disconnection unit as disclosed herein, said elastic device preferably comprises a first and second torsion springs which are coaxially mounted on said second rotation axis between said contact support and said first and second contact arms, respectively.

In a typical operative situation of a high voltage disconnection unit, according to the present invention, in a closed position of said disconnection unit said first movable main contact is coupled to said first fixed main contact, while said first movable auxiliary contact is uncoupled from said first fixed auxiliary contact. Thus, in the closed position, the current flows only through the first main fixed and movable contacts. Alternatively, in the closed position both first movable main and auxiliary contacts are engaged with the corresponding fixed contacts.

Then, the opening operation of said disconnection unit typically comprises a first step in which the first movable main contact rotates and remains into contact with the first fixed main contact while the first movable auxiliary contact is brought into contact with the first fixed auxiliary contact. During this phase the current flows through the first main fixed and movable contacts as well as through the first auxiliary fixed and movable contacts. This first step is not present when in the closed position both first movable main and auxiliary contacts are engaged with the corresponding fixed contacts.

In a second step of the opening operation of the disconnection unit, the first movable main contact continues to rotate and is uncoupled from said first fixed main contact with said opening speed V2 while the first movable auxiliary contact is bent back in a direction opposite to the rotation direction of said first movable main contact and slides on said first fixed auxiliary contact maintaining an electrical contact with it. Thus during this phase, the current path is commutated from the main contacts to the auxiliary contacts.

Then, in a third step of the opening operation of the disconnection unit, the first movable main contact continues to rotate while the first movable auxiliary contact snaps away from said first fixed auxiliary contact with said opening speed V1. This is the phase in which the actual separation between the movable and fixed contact assemblies takes place and an electrical arc is formed. As previously explained, since the opening speed V1 can be very high with respect to the conventional opening speeds (i.e., typically with respect to the opening speed V2 imparted by the drive to the main movable contact), the arc duration can be greatly reduced, thereby minimizing the adverse effects described before.

Finally, in the open position of the disconnection unit both said first movable main and auxiliary contacts are uncoupled from the corresponding first fixed main and auxiliary contacts.

In a preferred embodiment of the presently disclosed high voltage disconnection unit, in said third step said first movable auxiliary contact preferably snaps away from said first fixed auxiliary contact by rotation in the same direction of said first movable main contact under the action of said elastic device.

As better explained hereinafter, in preferred embodiments of the present invention the first movable auxiliary contact, during a phase of the opening operation, is bent back in a direction opposite to the rotation direction of said first movable main contact by mechanical interference with a surface of the first fixed auxiliary contact thereby loading the elastic device, e.g. the spring device.

Then, in a subsequent phase of the opening operation, the mechanical interference between the first movable auxiliary contact and the first fixed auxiliary contact ceases and the first movable auxiliary contact is free to quickly snap under the action the elastic device in the rotation direction of said first movable main contact, thereby achieving separation from the corresponding first fixed auxiliary contact.

In other words, in a largely preferred embodiment of the present invention, in this latter operating phase the forces exerted by the elastic means acting on the first movable auxiliary contact overcome the mechanical resistance between the first movable auxiliary contact and the first fixed auxiliary contact. The first movable auxiliary contact is therefore free to quickly snap away from said first fixed auxiliary contact by rotating counterclockwise with said opening speed V1 which is substantially given by the rotation angular speed of said first movable auxiliary contact around its rotation axis.

According to embodiments of a high voltage disconnection unit according to the present invention, said disconnection unit can comprise at least a second fixed contact assembly.

Preferably, said second fixed contact assembly is conveniently spaced apart form said first fixed contact assembly and in an embodiment lies in the rotation plane of said first movable main contact. In practice, according to this embodiment the first movable main contact can be coupled with any of the first or second fixed contact assembly by rotation through successive contact positions. According to a preferred alternative embodiment, said second fixed contact assembly lies outside the rotation plane of said first movable main contact and the movable contacts assembly is conveniently provided with second movable main and auxiliary contacts couplable/uncouplable to said second fixed contact in a manner similar to the first fixed and movable contacts.

In a further preferred embodiment of a high voltage disconnection unit according to the present invention, said disconnection unit can comprise a third fixed contact assembly which is spaced apart form said first and second fixed contact assemblies and lies in the rotation plane of said first movable main contact, one of said second and third fixed contact assembly being at ground potential. In this way it is possible to carry out the typical combined disconnection and earthing operation of a high voltage switchgear.

In particular, if the fixed contact at ground potential is provided with a corresponding fixed auxiliary contact, it is possible to reach the more severe ratings of the Induced Current Switching test specified in IEC 62271-102 Annex C, which otherwise requires the use of a much more expensive fast earthing disconnector.

A high voltage switchgear comprising a disconnection unit as disclosed is also part of the present invention.

Further features and advantages of the present invention will be more clear from the description of preferred but not exclusive embodiments of a high voltage disconnection unit of the present invention, shown by way of examples in the accompanying drawings, wherein.

Figure 1:
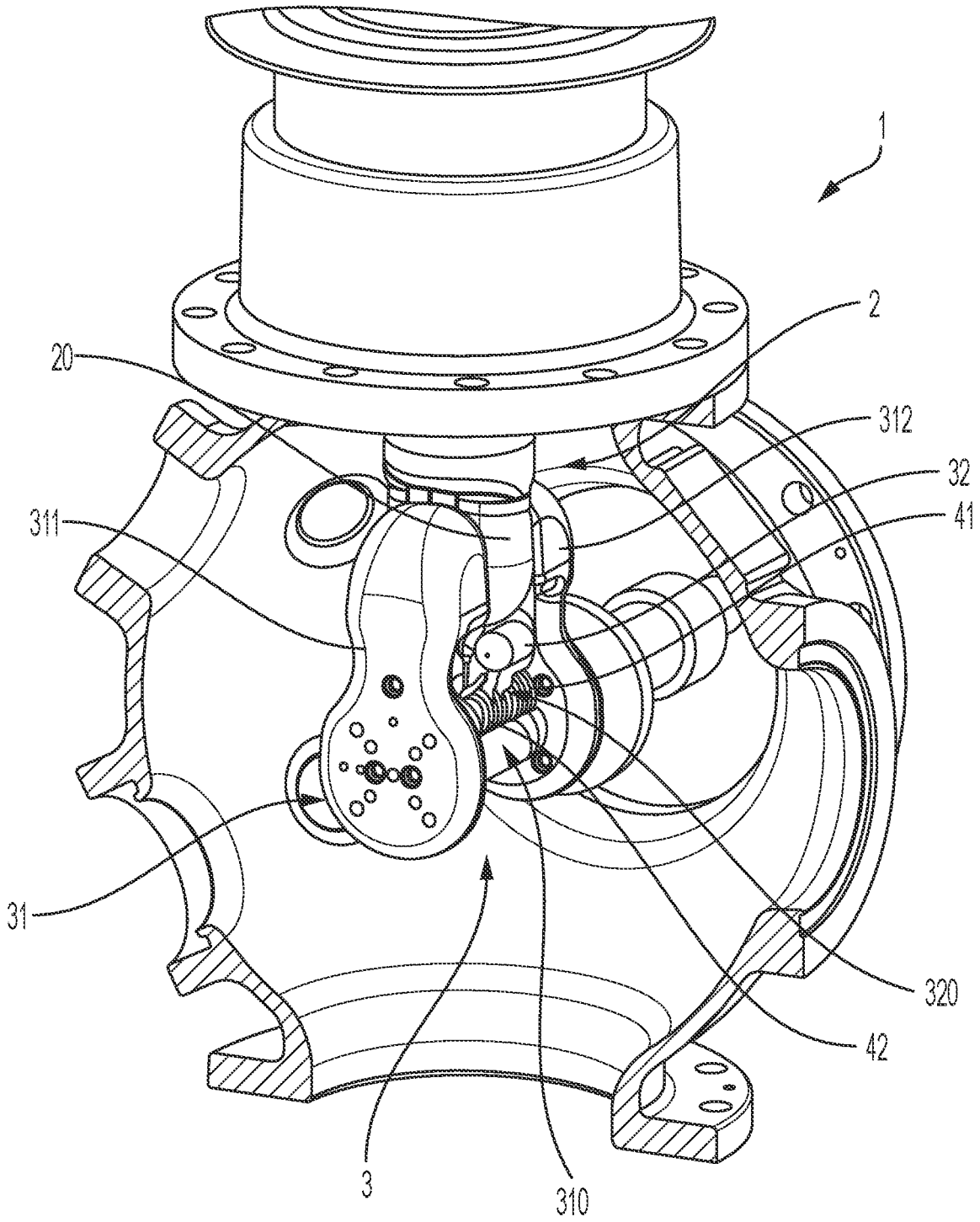
FIG. 1 is a perspective view of an embodiment of a high voltage disconnection unit, according to the invention, in the contact closed position.

With reference to the attached figures, the high voltage disconnection unit of the present invention, designated by the reference numeral 1, in its more general definition, comprises a fixed contact assembly 2, which has at least a first fixed main contact 21 and a first fixed auxiliary contact 22.

The disconnection unit 1 further comprises a movable contact assembly 3, which has at least a first movable main contact 31 and a first movable auxiliary contact 32 that rotate with respect to said first fixed main contact 21 and first fixed auxiliary contact 22 from a contacts closed position to a contacts open position. According to known embodiments, the first movable main contact 31 can be operatively connected to a motor drive, e.g. a rotating motor electronically controlled, that imparts to said first movable main contact 31 a rotation movement to carry out the desired opening or closing operation.

One of the distinguishing features of the disconnection unit 1 of the present invention is given by the fact that during an opening operation of said disconnection unit 1 the separation of said first movable main contact 31 from said first fixed main contact 21 takes place before the separation of said first movable auxiliary contact 32 from the corresponding first fixed auxiliary contact 22.

Furthermore, the disconnection unit 1 of the present invention is characterized in that the relative opening speed V1 between the first movable auxiliary contact 32 and said first fixed auxiliary contact 22 is greater than the relative opening speed V2 between said first movable main contact 31 and said first fixed main contact 21.

In other words, in the disconnection unit 1 of the present invention the separation between the main contacts 21 and 31 takes place at different times and with different speeds with respect to the separation between the auxiliary contacts 32 and 22.

In a typical embodiment of a high voltage disconnection unit 1, the movable contact assembly 3 further comprises an elastic device 4 acting on said first movable auxiliary contact 32 with a snapping action that imparts to said first movable auxiliary contact 32 said opening speed V2. In other words, while the first movable main contact 31 is moved at a speed V2 by, e.g., a motor drive, the opening operation of the first movable auxiliary contact 32 is actuated by the elastic device 4 with a snapping action at a speed V1 which is greater than the speed V2 of the first movable main contact 31

Preferably, said elastic device 4 can conveniently comprise a spring device, for example one or more torsion springs suitably positioned.

In the embodiments shown, the opening/closing operation of the high voltage disconnection unit 1 takes place by rotation of said first movable main contact 31 around a first rotation axis 310 and by rotation of said first movable auxiliary contact 32 around a second rotation axis 320.

Figure 2:
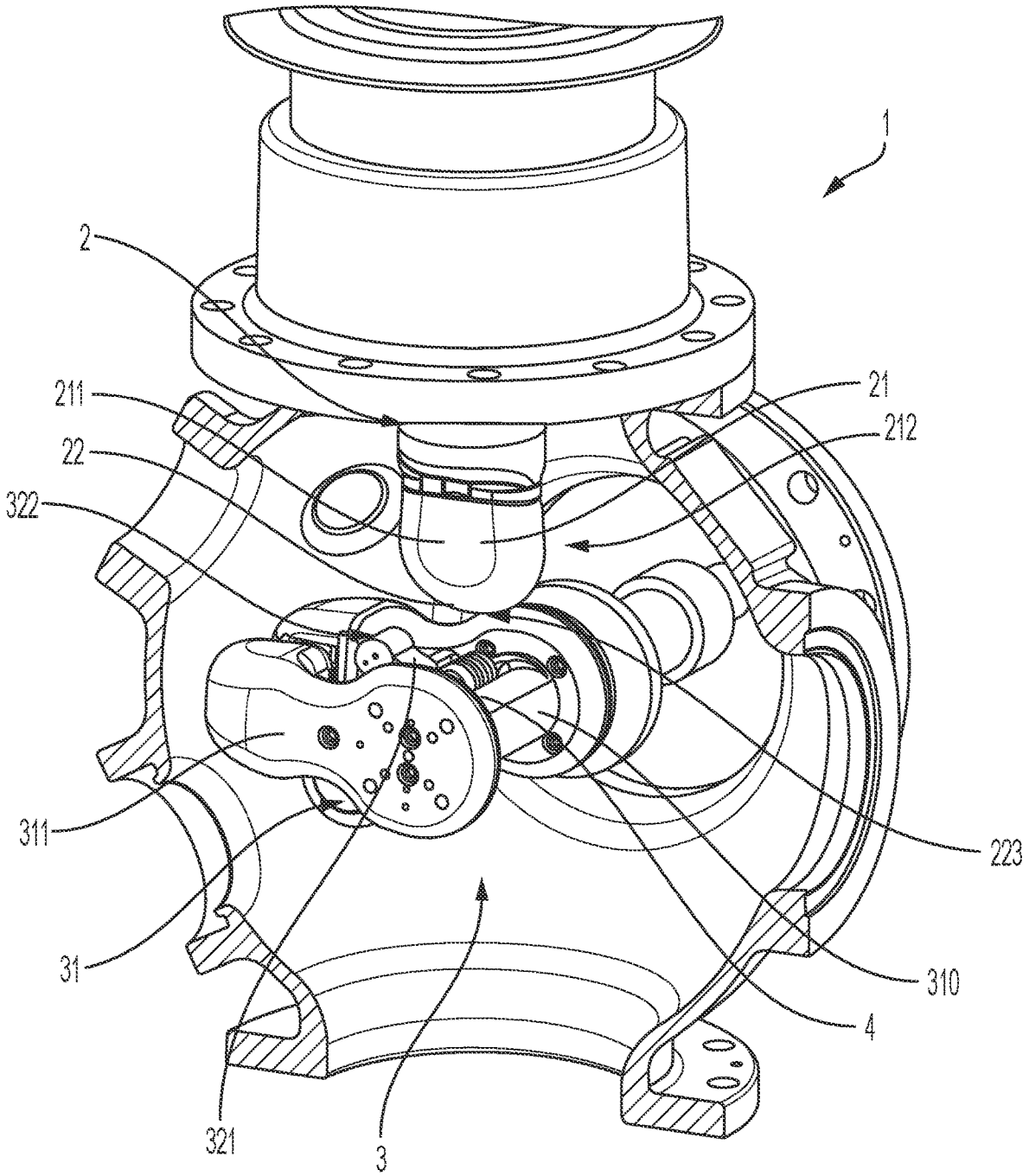
FIG. 2 is a perspective view of an embodiment of a high voltage disconnection unit, according to the invention, in the contact open position.
Figure 3:
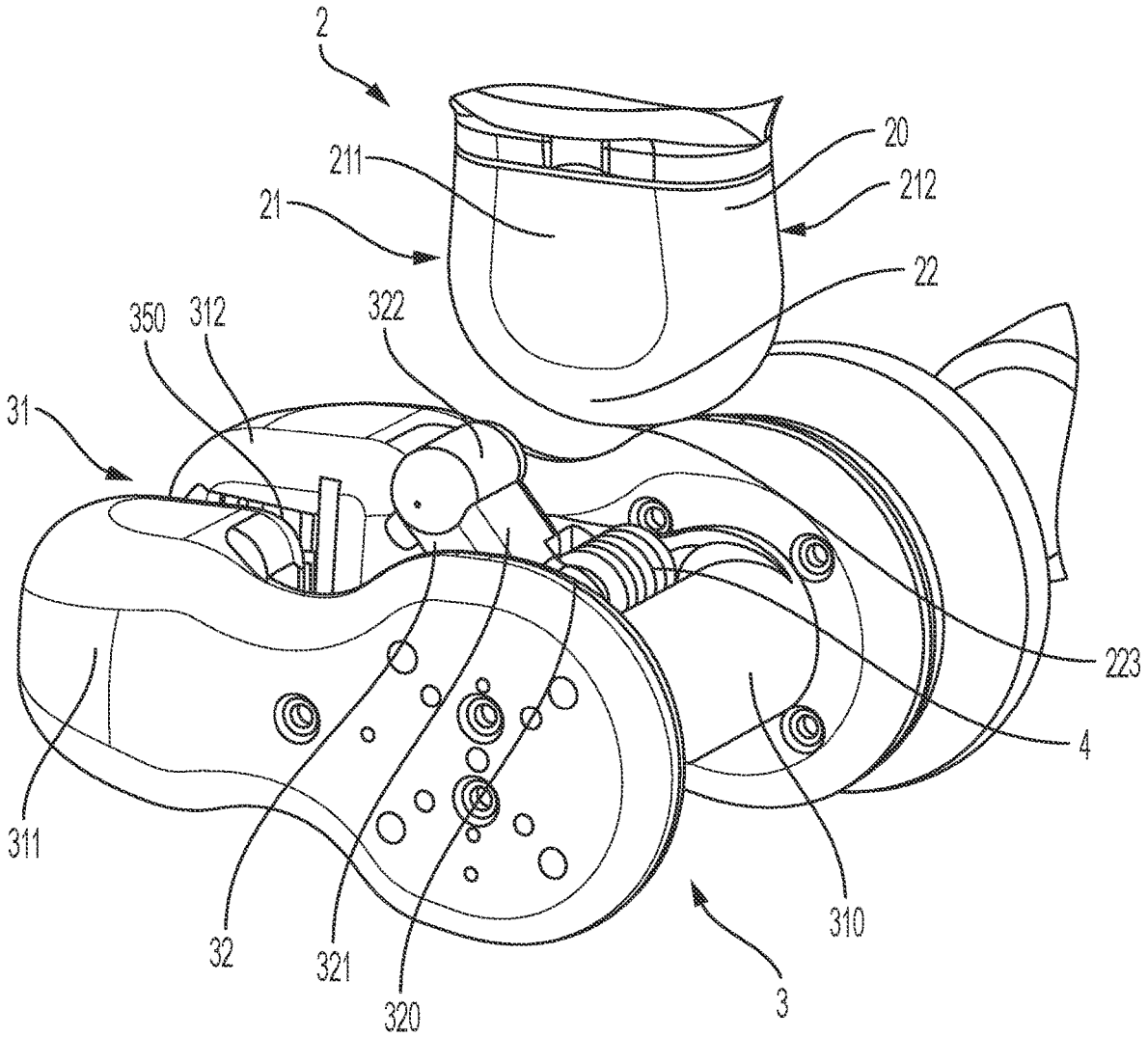
FIG. 3 is a more detailed perspective view of an embodiment of a high voltage disconnection unit, according to the invention, in the contact open position.

With particular reference to FIGS. 1-3, the position of the first rotation axis 310 is fixed with respect to said to said first fixed main 21 and auxiliary 22 contacts, while the second rotation axis 320 is pivotally fixed on said first movable main contact 31, in particular in an eccentric position of it with respect to said first rotation axis 310.

In practice, the opening speed V1 is given by the rotation angular speed of the first movable auxiliary contact 32 around said second rotation axis 320, while the opening speed V2 is given by the rotation angular speed of the first movable main contact 31 around said first rotation axis 310.

Thus, the relative position of said second rotation axis 320 with respect to said first fixed main 21 and auxiliary 22 contacts changes during a rotation of said first movable main contact 31. In particular, in the closed position of FIG. 1, the second rotation axis 320 is positioned between the first rotation axis 310 and the fixed main 21 and auxiliary 22 contacts, while in the open position of FIGS. 2 and 3 the second rotation axis 320 is moved counterclockwise and its distance from the fixed main 21 and auxiliary 22 contacts is increased.

In the embodiments of a high voltage disconnection unit 1 shown in the attached figures, said first movable main contact 31 comprises a first 311 and a second 312 contact arms which are parallel to each other. Also, the first 311 and second 312 contact arms are spaced apart from each other along said first rotation axis 310, thereby leaving a space between them.

In this way, said first movable auxiliary contact 32 can be conveniently positioned in said space between said first 311 and second 312 contact arms, thereby obtaining a very compact structure of the movable contacts assembly 3.

As shown in the embodiments of attached figure, the fixed contact assembly 2 comprises a fixed contact body 20 having an elongated shape that protrudes toward the movable contact assembly 3.

The first fixed main contact 21 then comprises a first 211 and a second 212 contact surfaces which are positioned on opposite faces of said elongated fixed contact body 20, while said first fixed auxiliary contact 22 comprises a third contact surface 223 which is positioned on a bottom portion of said fixed contact body 20, i.e. at the end of fixed contact body 20 close to the movable contact assembly 3.

In practice, as clearly shown in the attached figure, the first 211 and second 212 contact surfaces are substantially parallel to each other, while the third contact surface 223 is substantially perpendicular to said first 211 and second 212 contact surfaces.

Thus, from a construction standpoint, the fixed contact assembly 2 can be conveniently formed by a single fixed contact body 20, having two parallel surfaces 211 and 212 on a first and a second opposite face forming said first and second contact surfaces. The fixed contact body 20 is also provided with a third surface 223, on a third face perpendicular to said first and second opposite faces of said fixed contact body 20, forming said third contact surface. In this way, the overall design of the fixed contact assembly 2 can have a very compact design and can be manufactured very easily.

With particular reference to the embodiment shown in FIGS. 2 and 3, the first 311 and second 312 contact arms of said first movable main contact 31 each comprise contact strips 350 which are positioned on their respective facing surfaces, i.e. on the surfaces of the first 311 and second 312 contact arms facing each other.

The contact strips 350 are operatively couplable to said first 211 and second 212 contact surfaces of said fixed contact body 20 and provide a nominal current path when the disconnection unit 1 is in the closed position.

Then, the first movable auxiliary contact 32 comprises a contact support 321 which is in the form of an elongated body having a first end rigidly fixed on said second rotation axis 320 and a contact head 322 at a second end of said contact support 321.

The contact head 322 is operatively couplable to said third contact surfaces 223 of said fixed contact body 20 and provide a commutated current path during a phase of the opening operation of the disconnection unit 1.

In an embodiment of the high voltage disconnection unit 1, said elastic device 4 comprises a first 41 and second 42 torsion springs coaxially mounted on said second rotation axis 320 between said contact support 321 and said first 311 and second 312 contact arms, respectively.

With reference to the attached FIGS. 4-8, the opening operation of the high voltage disconnection unit 1 of the invention can be described as follows.

Figure 4:
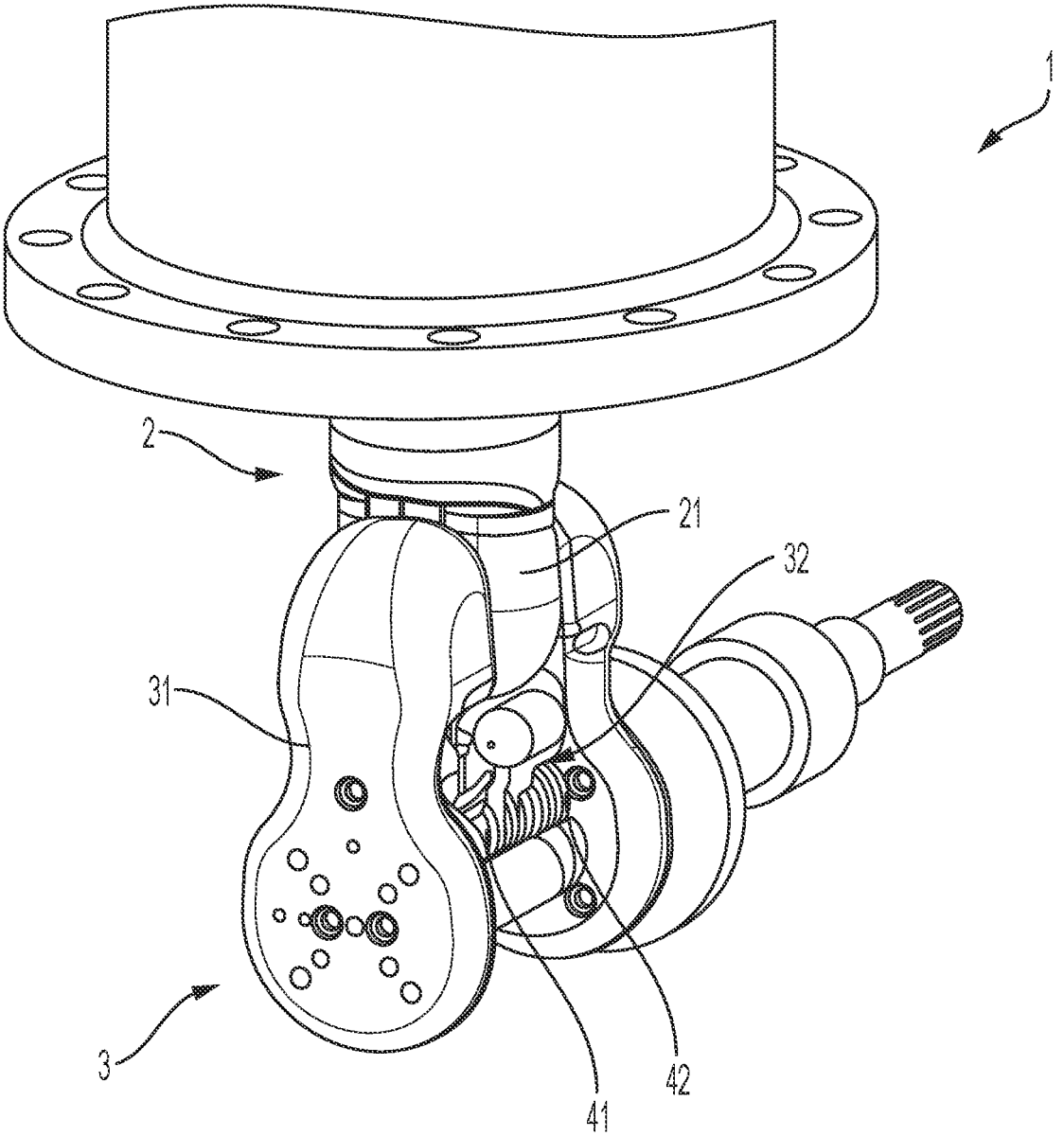
FIG. 4 is a second perspective view of an embodiment of a high voltage disconnection unit, according to the invention, in the contact closed position.

With reference to FIG. 4, in a closed position of said disconnection unit 1 the first movable main contact 31 is coupled to said first fixed main contact 21, thereby providing a nominal current path, while said first movable auxiliary contact 32 is uncoupled from said first fixed auxiliary contact 22.

Figure 5:
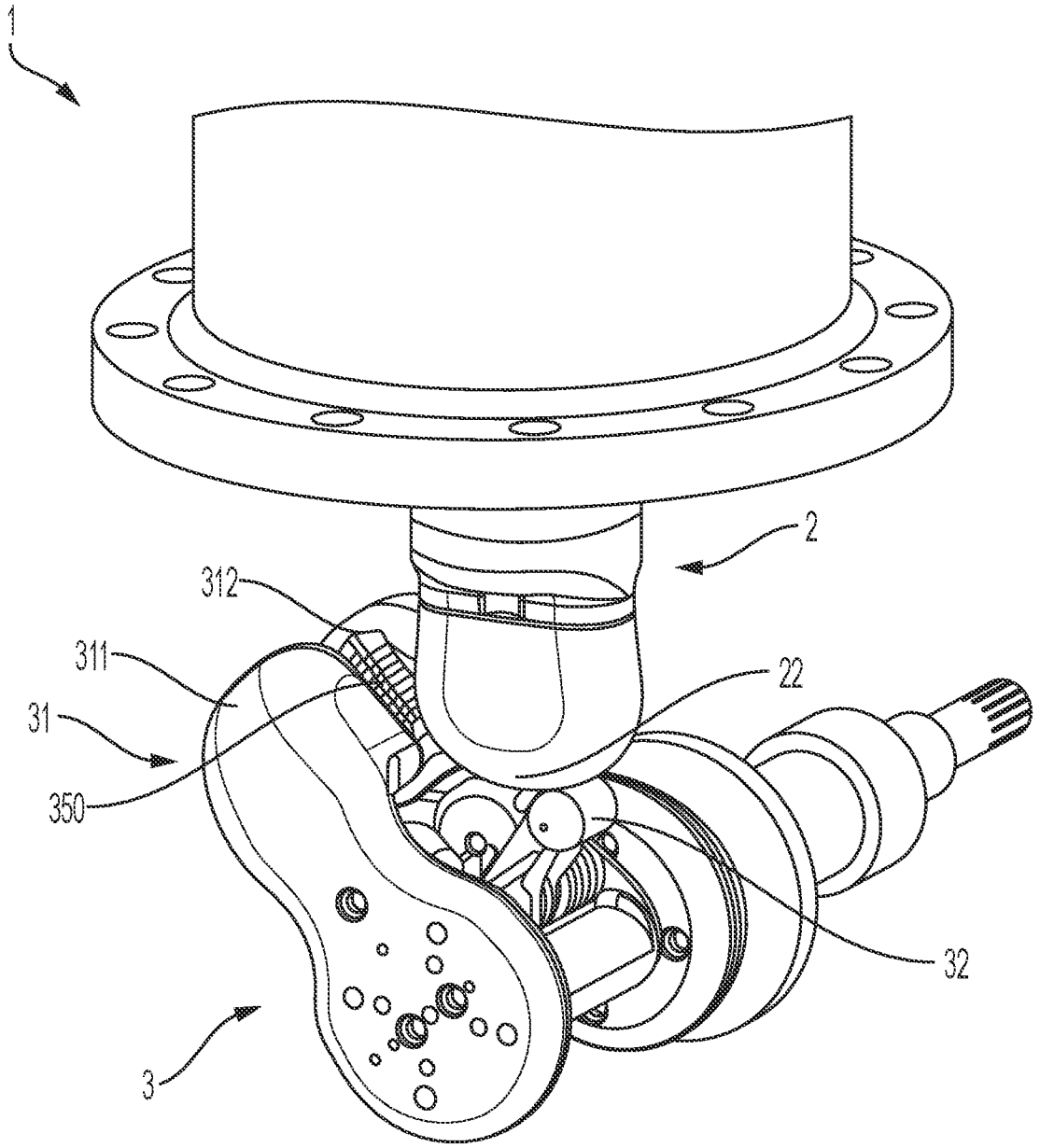
FIG. 5 is a perspective view of a first phase of the opening operation of a high voltage disconnection unit, according to the invention.

Then, with reference to FIG. 5, in a first step of the opening operation, the first movable main contact 31 rotates, e.g. counterclockwise, and remain into contact with the first fixed main contact 21 while the first movable auxiliary contact 32 is brought into contact with the first fixed auxiliary contact 22. During this phase the current may flow through both the main 21, 31 and auxiliary 22, 32 contacts system with an intensity that depends upon the contact resistance of the main 21, 31 and auxiliary 22, 32 contacts system.

As previously said, in a more general embodiment of the high voltage disconnection unit 1, in the closed position both first movable main 31 and auxiliary 32 contacts are engaged with the corresponding fixed main 21 and auxiliary 22 contacts and in such a case the above described first step is not present.

Figure 6:
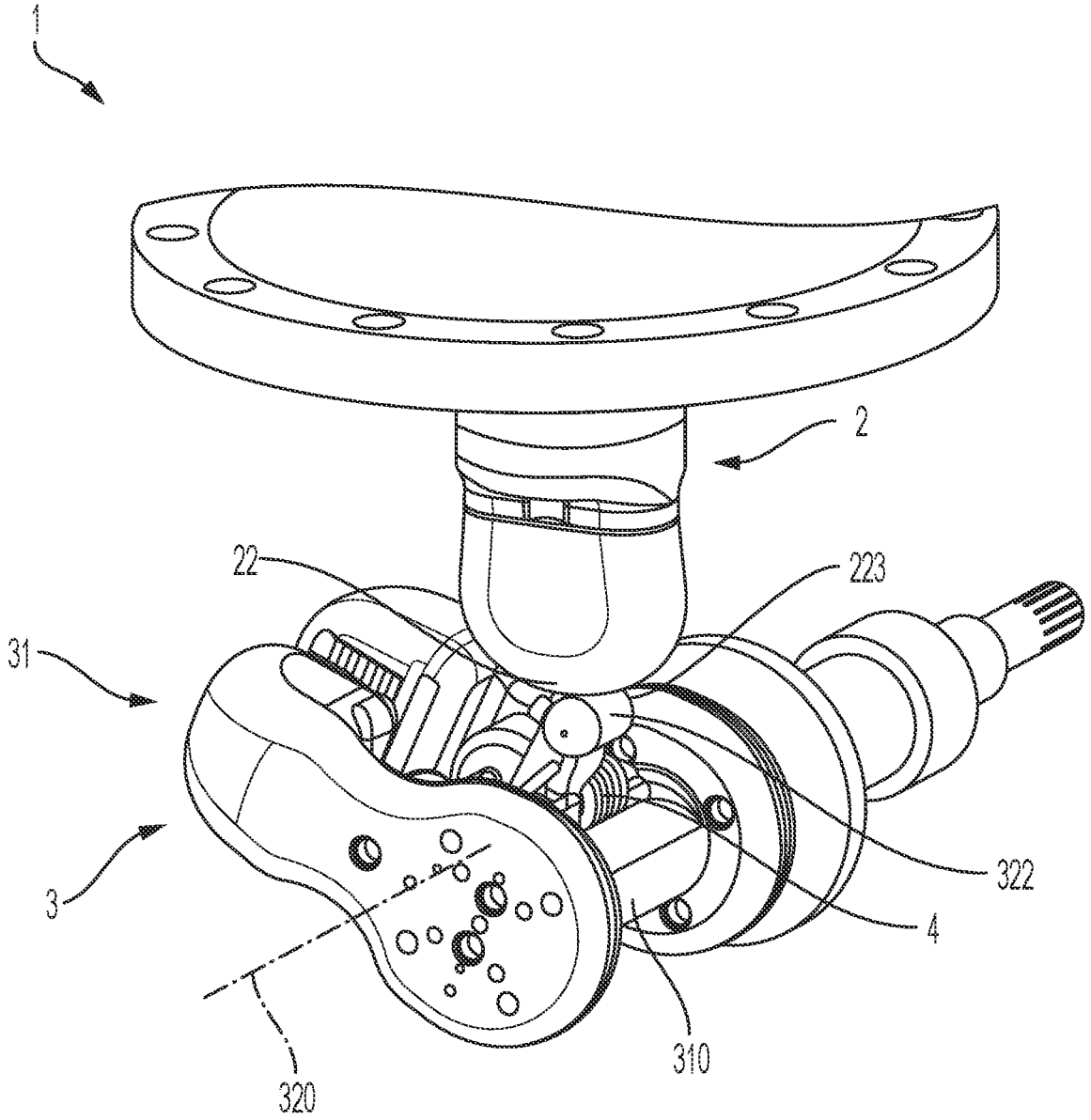
FIG. 6 is a perspective view of a second phase of the opening operation of a high voltage disconnection unit, according to the invention.

In a second step of the opening operation, shown in FIG. 6, the first movable main contact 31 continues to rotate counterclockwise and is uncoupled from the first fixed main contact 21 (main contacts opening) with said opening speed V2 while the first movable auxiliary contact 32 is bent back clockwise in a direction opposite to the rotation direction of said first movable main contact 31 and slides on said first fixed auxiliary contact 21 maintaining an electrical contact with it. During this phase the current path is therefore commutated from the main contacts system to the auxiliary contact systems. At the same time, the mechanical interference between the first movable auxiliary contact 32 and the first fixed auxiliary contact 22, which forces the first movable auxiliary contact 32 to be bent back and rotate clockwise, brings about loading of the elastic means 4.

Figure 7:
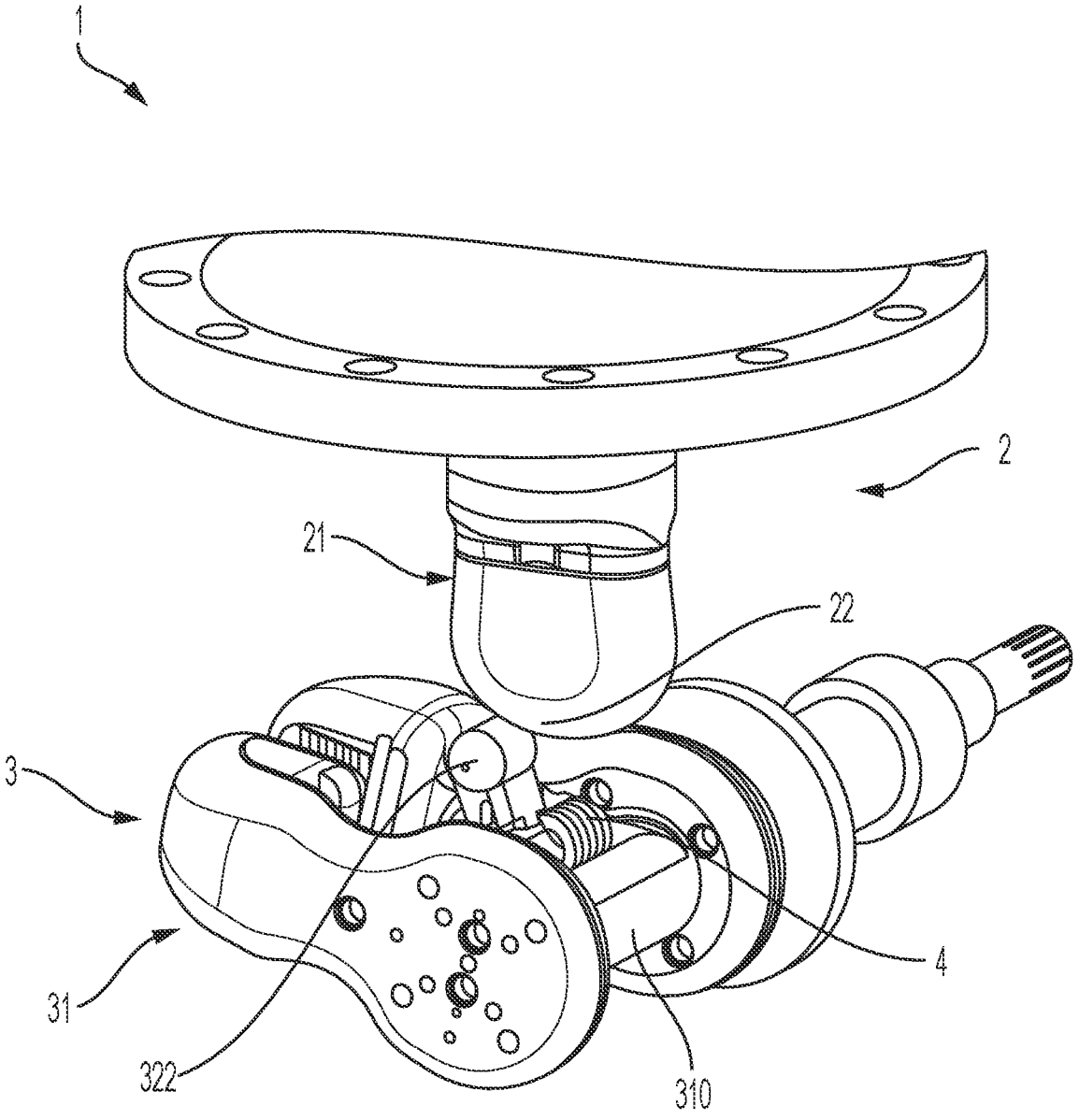
FIG. 7 is a perspective view of a third phase of the opening operation of a high voltage disconnection unit, according to the invention.

The first movable main contact 31 then continues to rotate counterclockwise and the first movable auxiliary contact 32 slides on the first fixed auxiliary contact 21 while its rotation axis 320 is moved away from the fixed contact assembly until when the position of FIG. 7 is reached.

In such position, the forces exerted by the elastic means 4 overcome the mechanical resistance between the first movable auxiliary contact 32 and the first fixed auxiliary contact 22. The first movable auxiliary contact 32 is therefore free to quickly snap away from said first fixed auxiliary contact 22 by rotating counterclockwise with said opening speed V1 which is substantially given by the rotation angular speed of said first movable auxiliary contact 32 around its rotation axis 320.

Figure 8:
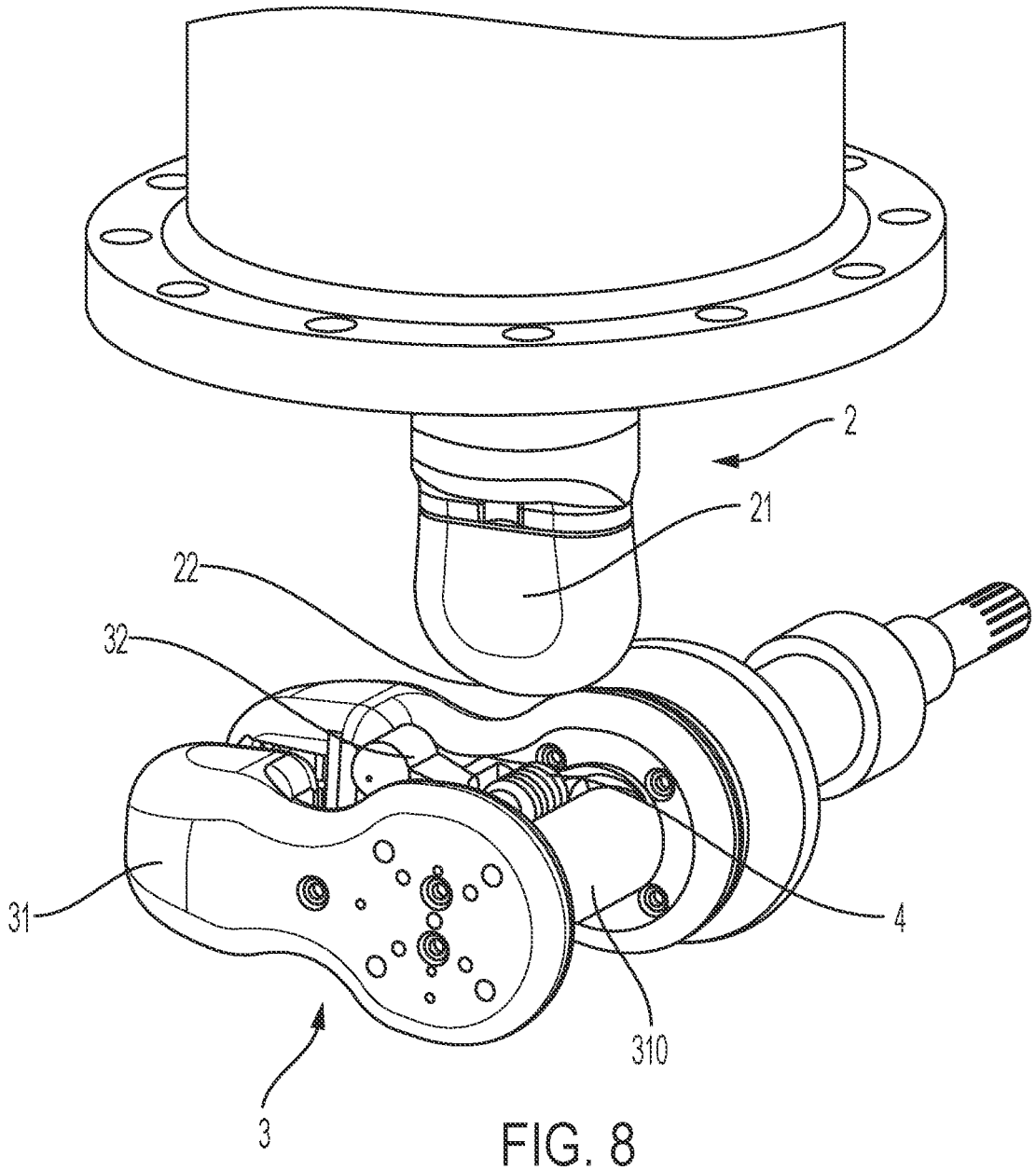
FIG. 8 is a second perspective view of an embodiment of a high voltage disconnection unit, according to the invention, in the contact open position.

Finally, with reference to FIG. 8, in the open position both said first movable main 31 and auxiliary 32 contacts are uncoupled from the corresponding first fixed main 21 and auxiliary 22 contacts.

The opening operation of the high voltage disconnection unit 1 has been described with reference to a counterclockwise motion of the first movable main contact 31 and an initial clockwise motion of the first movable auxiliary contact 32, followed by a counterclockwise snap action of the same. The operation can obviously takes place in a similar manner by rotating the first movable main contact 31 clockwise and the first movable auxiliary contact 32 initially counterclockwise and then clockwise.

According to particular embodiments of the high voltage disconnection unit 1 not represented in the attached figures, said disconnection unit 1 can comprise at least a second fixed contact assembly.

The second fixed contact assembly is conveniently spaced apart from the first fixed contact assembly 2 and lies in the rotation plane of the first movable main contact 31. In practice, according to this embodiment the first movable main contact 31 can be coupled with any of the first 2 or second fixed contact assembly by rotation through successive contact positions. Furthermore, said disconnection unit 1 can comprise a third fixed contact assembly which is spaced apart form said first 2 and second fixed contact assemblies and lies in the rotation plane of said first movable main contact 31, one of said second 2 and third fixed contact assembly being at ground potential. In this way it is possible to carry out the typical combined disconnection and earthing operation of a high voltage switchgear It is clear from the above description that the presently disclosed high voltage disconnection unit fully solve the underlined technical problems of the prior art disconnection units.

In particular the high separation speed between the auxiliary fixed and main contacts that can be achieved with the present invention allows reducing the arc duration with respect to the conventional disconnection units. As a consequence, the ablation of the contact surfaces in case of formation of an electrical arc is significantly reduced. This has a very positive impact not only on the operative life of the disconnection unit but also on its capability to pass the Bus Transfer standard test with a certain safety margin as well as more in general to increase the power test performances.

Moreover, since the ablation of the contact is significantly reduced due to less arc exposure, the risk of pre-striking during the closing operation is also significantly reduced, thereby greatly improving the performances of the high voltage disconnection unit also during the closing operation.

It also worth noting that the structure of the disconnection unit is extremely simple and with a reduced number of components, thereby minimizing the manufacturing and maintenance costs. In addition the structure is extremely compact and allows to greatly optimize the spaces and the volumes within the disconnection unit.

Several variations can be made to the high voltage disconnection unit thus conceived, all falling within the scope of the attached claims. In practice, the materials used and the contingent dimensions and shapes can be any, according to requirements and to the state of the art.

The invention claimed is:

1. A high voltage disconnection unit comprising:

a fixed contact assembly having at least a first fixed main contact and a first fixed auxiliary contact, and a movable contact assembly having at least a first movable main contact and a first movable auxiliary contact that rotate with respect to the first fixed main contact and the first fixed auxiliary contact from a closed position to an open position, wherein the first movable main contact comprises a plurality of contact strips operatively couplable to the fixed contact assembly for providing a current path when the high voltage disconnection unit is in the closed position;

wherein during an opening operation of the high voltage disconnection unit, separation of the first movable main contact from the first fixed main contact takes place before separation of the first movable auxiliary contact from the first fixed auxiliary contact; and wherein a relative auxiliary opening speed between the first movable auxiliary contact and the first fixed auxiliary contact is greater than a relative main opening speed between the first movable main contact and the first fixed main contact.

2. The high voltage disconnection unit, according to claim 1, wherein said movable contact assembly comprises an elastic device acting on said first movable auxiliary contact with a snapping action that imparts to said first movable auxiliary contact said relative main opening speed.

3. The high voltage disconnection unit, according to claim 2, wherein said elastic device comprises a spring device.

4. The high voltage disconnection unit, according to claim 1, wherein said first movable main contact rotates around a first rotation axis and said first movable auxiliary contact rotates around a second rotation axis, said relative auxiliary opening speed being a rotation angular speed of said first movable auxiliary contact around said second rotation axis, said relative main opening speed being a rotation angular speed of said first movable main contact around said first rotation axis.

5. The high voltage disconnection unit, according to claim 4, wherein said second rotation axis is pivotally fixed on said first movable main contact, a relative position of said second rotation axis with respect to said first fixed main and auxiliary contacts changing during a rotation of said first movable main contact.

6. The high voltage disconnection unit, according to claim 1, wherein said first movable main contact comprises first and second contact arms parallel to and spaced apart from each other along a first rotation axis, said first movable auxiliary contact being positioned in between said first and second contact arms.

7. The high voltage disconnection unit, according to claim 1, wherein said fixed contact assembly comprises a fixed contact body, said first fixed main contact comprising first and second contact surfaces positioned on opposite faces of said fixed contact body, said first fixed auxiliary contact comprising a third contact surface positioned on a bottom portion of said fixed contact body, said first and second contact surfaces being substantially parallel to each other, said third contact surface being substantially perpendicular to said first and second contact surfaces.

8. The high voltage disconnection unit, according to claim 7, wherein said first movable main contact comprises first and second contact arms parallel to and spaced apart from each other along a first rotation axis, said first movable auxiliary contact being positioned in between said first and second contact arms; and wherein said first and second contact arms of said first movable main contact comprise the contact strips on their respective facing surfaces, said contact strips being operatively couplable to said first and second contact surfaces of said fixed contact body, said first movable auxiliary contact comprising a contact support rigidly fixed on said second rotation axis and a contact head at an end of said contact support, said contact head being operatively couplable to said third contact surfaces of said fixed contact body.

9. The high voltage disconnection unit, according to claim 8, wherein said movable contact assembly comprises an elastic device acting on said first movable auxiliary contact with a snapping action that imparts to said first movable auxiliary contact said relative main opening speed, and wherein said elastic device comprises first and second torsion springs coaxially mounted on said second rotation axis between said contact support and said first and second contact arms, respectively.

10. The high voltage disconnection unit, according to claim 1, wherein in the closed position of said disconnection unit said first movable main contact is coupled to said first fixed main contact, while said first movable auxiliary contact is uncoupled from said first fixed auxiliary contact, and wherein the opening operation of said disconnection unit comprises a first step in which the first movable main contact rotates and remains in contact with the first fixed main contact while the first movable auxiliary contact is brought into contact with the first fixed auxiliary contact, a second step in which the first movable main contact continues to rotate and is uncoupled from said first fixed main contact with said relative main opening speed while the first movable auxiliary contact is bent back in a direction opposite to a rotation direction of said first movable main contact and slides on said first fixed auxiliary contact maintaining an electrical contact, a third step in which the first movable main contact continues to rotate while the first movable auxiliary contact snaps away from said first fixed auxiliary contact with said relative auxiliary opening speed, and a fourth step in which both said first movable main and auxiliary contacts are uncoupled from a corresponding first fixed main and auxiliary contacts.

11. The high voltage disconnection unit, according to claim 10, wherein said movable contact assembly comprises an elastic device acting on said first movable auxiliary contact with a snapping action that imparts to said first movable auxiliary contact said relative main opening speed, and wherein in said third step said first movable auxiliary contact snaps away from said first fixed auxiliary contact by rotation in a direction the same as the rotation direction of said first movable main contact under an action of said elastic device.

12. The high voltage disconnection unit, according to claim 1, further comprising at least a second fixed contact assembly which is spaced apart form said first fixed contact assembly.

13. The high voltage disconnection unit, according to claim 12, further comprising a third fixed contact assembly which is spaced apart form said first and second fixed contact assemblies, one of said second and third fixed contact assembly being at ground potential.

14. A high voltage switchgear comprising the disconnection unit according to claim 1.

15. A high voltage disconnection unit comprising:

a fixed contact assembly;

a movable contact assembly;

the fixed contact assembly comprising a first fixed main contact and a first fixed auxiliary contact;

the movable contact assembly comprising a first movable main contact and a first movable auxiliary contact; and the first movable main contact and the first movable auxiliary contact being respectively rotatable with respect to the first fixed main contact and the first fixed auxiliary contact in between a closed position and an open position, wherein the first movable main contact comprises a plurality of contact strips operatively couplable to the fixed contact assembly for providing a current path when the high voltage disconnection unit is in the closed position.

16. The high voltage disconnection unit, according to claim 15, further comprising:

during an opening operation of the high voltage disconnection unit, separation of the first movable main contact from the first fixed main contact taking place before separation of the first movable auxiliary contact from the first fixed auxiliary contact.

17. The high voltage disconnection unit, according to claim 15, further comprising:

a relative auxiliary opening speed between the first movable auxiliary contact and the first fixed auxiliary contact being greater than a relative main opening speed between the first movable main contact and the first fixed main contact.

18. The high voltage disconnection unit, according to claim 15, further comprising:

the high voltage disconnection unit being operated in between the closed position and the open position;

in response to the high voltage disconnection unit being in the closed position, the first movable main contact being coupled to the first fixed main contact while the first movable auxiliary contact being uncoupled from the first fixed auxiliary contact;

an opening operation of the high voltage disconnection unit from the closed position to the open position comprising:

a first step in which the first movable main contact rotates and remains in contact with the first fixed main contact while the first movable auxiliary contact rotates and is brought into contact with the first fixed auxiliary contact;

a second step in which the first movable main contact continues to rotate and is uncoupled from the first fixed main contact while the first movable auxiliary contact continues to rotate and is bent back in a direction opposite to a rotation direction of the first movable main contact and slides on the first fixed auxiliary contact so as to maintain an electrical contact;

a third step in which the first movable main contact remains in non-contact with the first fixed main contact while the first movable auxiliary contact continues to rotate and snaps away from the first fixed auxiliary contact; and a fourth step in which the first movable main contact remains in non-contact with the first fixed main contact while the first movable auxiliary contact continues to rotate and is uncoupled from the first fixed auxiliary contact.

19. The high voltage disconnection unit, according to claim 18, further comprising:

the second step in which the first movable main contact continues to rotate and is uncoupled from the first fixed main contact with a relative main opening speed;

the third step in which the first movable auxiliary contact continues to rotate and snaps away from the first fixed auxiliary contact with a relative auxiliary opening speed; and the relative auxiliary opening speed being greater than the relative main opening speed.

* * * * *